US006443776B2

(12) United States Patent
Reichle

(10) Patent No.: US 6,443,776 B2
(45) Date of Patent: Sep. 3, 2002

(54) PLUG CONNECTOR PART

(75) Inventor: Hans Reichle, Wetzikon (CH)

(73) Assignee: Reichle & De-Massari AG, Wetzikon (CH)

( * ) Notice: Subject to any disclaimer, the term of this patent is extended or adjusted under 35 U.S.C. 154(b) by 0 days.

(21) Appl. No.: 09/784,185

(22) Filed: Feb. 16, 2001

(30) Foreign Application Priority Data

Feb. 21, 2000 (CH) ..... 0327/00

(51) Int. Cl.[7] ..... H01R 24/00
(52) U.S. Cl. ..... 439/676; 439/941
(58) Field of Search ..... 439/941, 676, 439/644, 405

(56) References Cited

U.S. PATENT DOCUMENTS 5,697,817 A * 12/1997 Bouchan et al. ..... 439/676
5,791,943 A * 8/1998 Lo et al. ..... 439/676
6,106,335 A * 8/2000 Merchant et al. ..... 439/620

FOREIGN PATENT DOCUMENTS

EP 0 955 703 A2 11/1999

* cited by examiner

*Primary Examiner*—Gary F. Paumen
*Assistant Examiner*—Ann McCamey
(74) *Attorney, Agent, or Firm*—Nath & Associates PLLC; Gary M. Nath; Marvin C. Berkowitz

(57) ABSTRACT

A plug connection part, in particular for RJ45 plug connectors, comprises a multiplicity of conductor paths which have at one end a contact spring and at the other end an output contact, where the contact springs starting from an end facing away from the output contact run towards the output contact, and where the conductor paths run at least partly mutually crossing in a compensation section following the contact springs and the conductor paths along a part length of the compensation section lie at least partly above each other and run electrically separated by means of an insulator arranged in between.

13 Claims, 3 Drawing Sheets

PLUG CONNECTOR PART

BACKGROUND OF THE INVENTION

The invention concerns a plug connector part, in particular for RJ45 plug connectors.

An RJ45 plug connector is standardized to DIN EN 60603 Part 7 IEC 60603-7 and used worldwide for plug connectors in communication and data networks. Conventional sockets for such RJ45 plug connectors have a standardized contact arrangement and opening geometry, also known as the plug face, and have cutting terminals or solder pins for connection of a data cable or for connection to a printed circuit board.

DESCRIPTION OF THE PRIOR ART

EP 0 955 703 A2discloses such a socket in which eight conductor paths are arranged essentially mutually parallel. This socket is designed for a bandwidth of category 5 (100 MHz bandwidth).

The disadvantage with this known socket is the fact that it is inadequate for electrical signals with a bandwidth above 100 MHz as between the conductor paths such a high cross-talk occurs that the signals transferred are unacceptably distorted. Because of the increasing bandwidth requirement in communication and data networks there is a need for the connectors of higher bandwidth. Therefore in the standardization group of the RJ45 standard a new category 6 has been defined which defines plug connectors with 200 MHz bandwidth.

The purpose of the present invention is to specify a plug connection part in particular for RJ45 plug connectors which has a lower cross-talk even for electrical signals with a bandwidth of at least 200 MHz.

SUMMARY OF THE INVENTION

The task is solved in particular with a plug connection part comprising a multiplicity of conductor paths which at one end have a contact spring and at the other end an output contact, where the contact springs run from the end facing away from the output contact towards the output contact, and where the conductor paths run at least partly mutually crossing in a compensation section after the contact springs, and the conductor paths lie above each other at least in part along a part length of the compensation section and run electrically separated by an insulator arranged in between.

The said standards for RJ45 plug connectors contain a definition for the structure of the plug face but there are no specifications for the course of the contacts beyond the plug area. Therefore RJ45 plug connectors with a multiplicity of differently arranged conductor paths are known. In particular for RJ45 connectors of category 5 it is known, for example from the said specification, to arrange the course of the conductor paths so that a targeted cross-talk compensation occurs. The common factor with all these plug connectors designed for signal bandwidth of 100 MHz is that they are scarcely or not at all suitable for higher bandwidths for the following physical reasons. The mechanical dimensions of these systems, in particular the distance between the plug and compensation and the extent of the compensations, are so great that even at high frequencies an additional phase offset occurs between the interference signal and the compensation signal, which restricts the effectiveness of the existing compensation for these frequencies.

Plug connection systems for a signal bandwidth of over 100 MHz must therefore be very thoughtfully designed for physical reasons. In particular it must be remembered that the RJ45 standard prescribes a plug with parallel conductors and a spread pair 3/6 which inevitably leads to an increased cross-talk. An RJ45 plug connector for a high signal bandwidths can therefore be produced only if it is possible by suitable technical measures to achieve cross-talk compensation.

The plug connection part according to the invention has compensation for cross-talk, where the compensation is designed extremely compact and contains both capacitative and inductive coupling paths. The conductor paths of the plug connection part have a minimum physical extension. Also certain conductor paths are crossed and for mutual compensation run in two parallel planes where between these two parallel planes is arranged an electrical insulator or a dielectric in order to achieve an amplified capacitative coupling path.

One advantage of the plug connector comprising the plug connection part according to the invention is the fact that even at signals of 200 MHz bandwidth the cross-talk only has a value of max. −48 dB.

Another advantage is the fact that the plug connection part can be designed very compact and small. This allows existing sockets to be replaced by a socket with the broadband plug connection part according to the invention in order to increase the bandwidths of existing networks. The twisted pair electrical conductors permanently laid in a building need not be changed, which allows low-cost expansion of the bandwidth.

As well as the 8-pin design disclosed below, the plug connection part according to the invention can also be produced with another number of pins, for example in 6-pin design according to the RJ11 standard.

BRIEF DESCRIPTION OF THE DRAWINGS

For a better understanding of the invention and to show how the same may be carried into effect, reference will now be made, by way of example, to the accompanying drawings, in which.

DESCRIPTION OF THE PREFERRED EMBODIMENT

Figure 1:
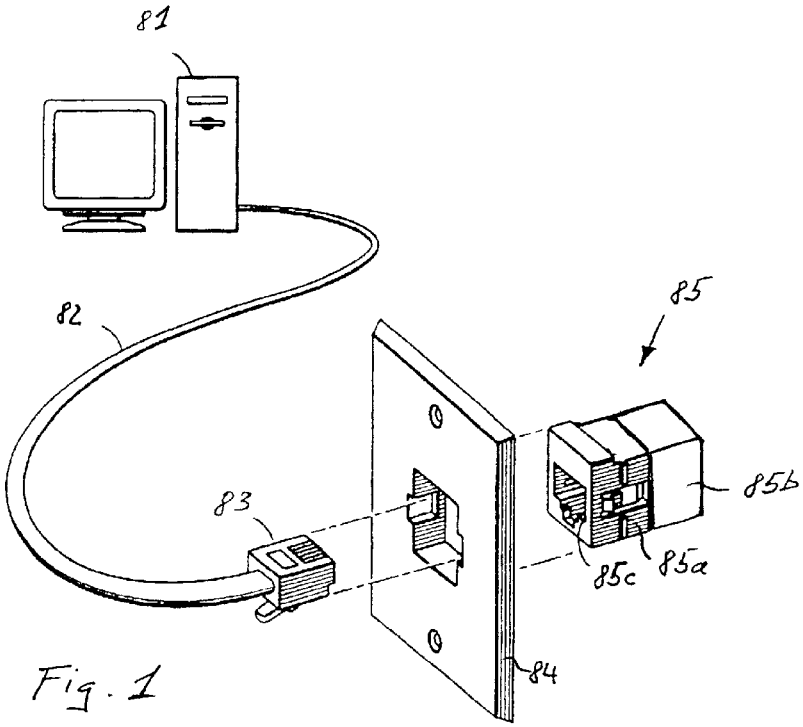
FIG. 1 is an RJ45 plug connector.

FIG. 1 shows a computer 81 which is connected via a cable 82 to a communication network known as a LAN. At the end of the cable 82 is fitted an RJ45 plug 83 or an 8-pin module plug 83. The cable 82 has 4 pairs of mutually twisted electrical conductors, known as "unshielded twisted pairs (UTP)" and for example is suitable for computer networks of high bandwidth or high speed. Behind a cover 84 is arranged the socket 85 or module socket 85 which holds a first part housing 85*a* with a cavity 85*c* for insertion of the plug 83 and a second part housing 85*b*.

Figure 2:
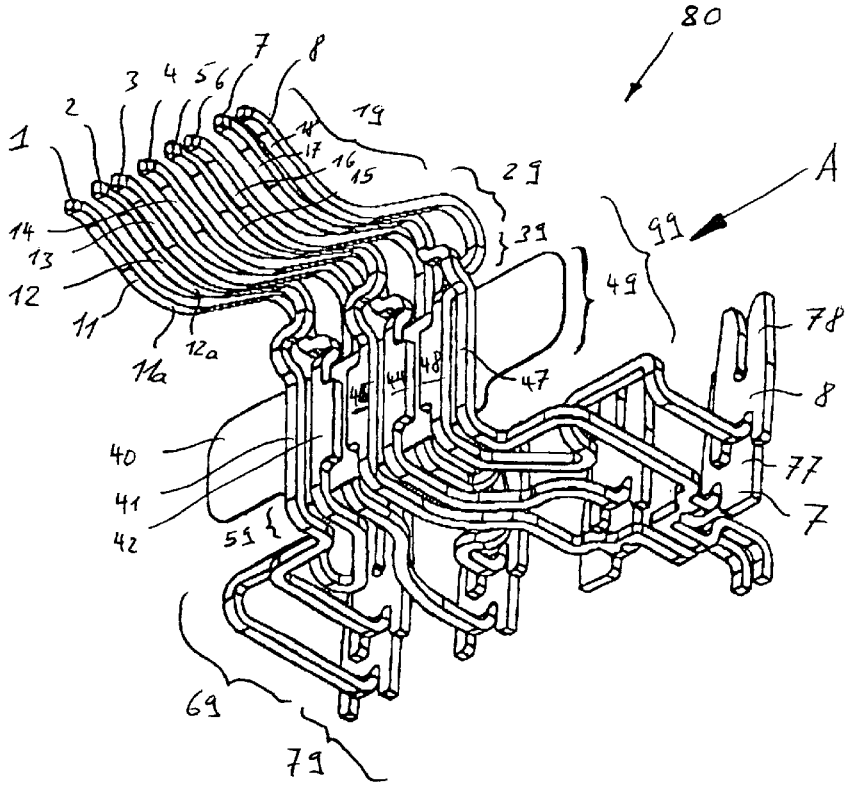
FIG. 2 is an first view of a plug connection part from direction B.

FIG. 2 shows a plug connection part 80 from view direction B. Eight conductor paths 1–8 each have at one end a contact spring 11–18 and that the other end an output contact 71–78 which is designed as a cutting terminal. The contact springs 11–18 run along a contact spring section 19 into a common area and are mutually parallel. The contact springs 11–18 are designed V-shaped in their longitudinal direction and each have a contact point 11*a*–18*a* which, with the plug 83 inserted, lie on the relevant contact points of the plug 83. The contact springs 11–18 start at one end facing away from the output contacts 71–78 and run towards the output contacts 71–78. The contact springs 11–18 open into a deflection section 29 within which the conductor paths 1–8 are deflected around 90 degrees. Then follows a crossover section 39 within which the conductor pairs 1,2; 4,5; and 7,8 cross mutually. The conductor paths 1–8 then run in two parallel planes spaced apart essentially in the running direction of the contact springs 11–18 so that a section 49 of parallel and offset conductor paths 1–8 is formed. Between the two spaced planes is arranged an electrical insulator 40 which forms a dielectric. The part lengths 41–48 of the conductor paths 1–8 arranged in the section 49 are partly structured spread in the longitudinal direction of the insulator 40 to create a correspondingly larger capacitance. Also individual part lengths 41–48 are arranged opposite the insulator 40 in order again to achieve an increased capacitance between the conductor paths 1–8. After the section 49 the conductor paths 1–8 open into a deflection section 59 within which the conductor paths 1–8 are deflected around 90 degrees. Then or coinciding with the deflection section 59 is arranged a crossover section 69 within which the conductor paths 1–8 cross as shown in FIG. 4*b* in the spread view. After the crossover section 69 is a cutting terminal area 79 with cutting terminal contacts 71–78.

The course of the conductor paths 1–8 can be structured such that at least some of the conductor paths 1–8 cross mutually in the deflection section 29, 59 so that the deflection section 29, 59 also corresponds to the crossover section 39, 69.

Figure 3:
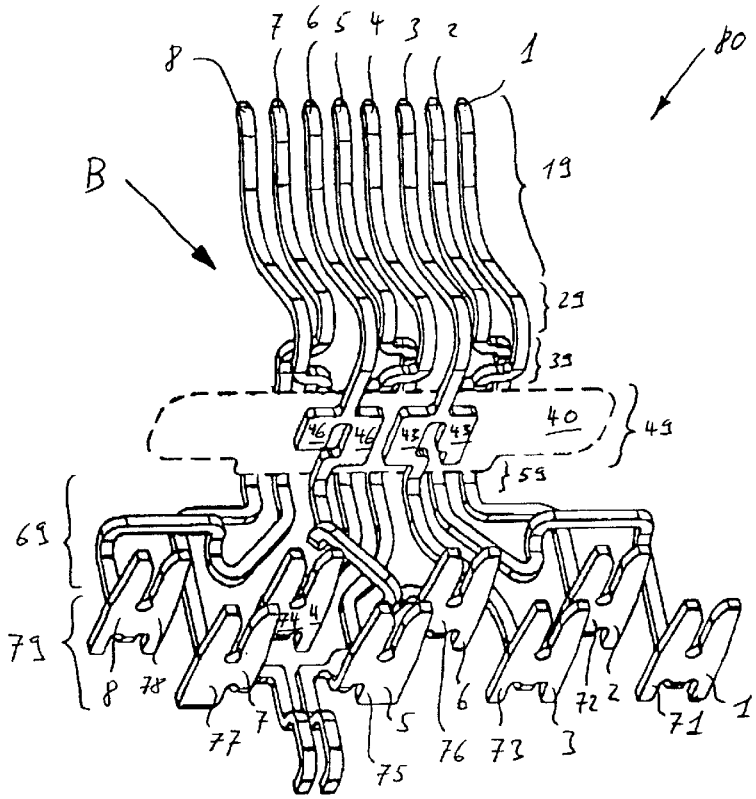
FIG. 3 is a second view of the plug connection part according to FIG. 2 from direction A.

FIG. 3 shows the plug connection part 80 shown in FIG. 2 from view direction A. The part lengths or shapes 43, 46 of the conductor paths 3 and 6 are clearly visible in the area of the section 49. The shapes 43, 46, separated only by the insulator 40, lie opposite the shapes 42, 45, 44, 48 and are arranged mutually parallel.

Figure 4A:
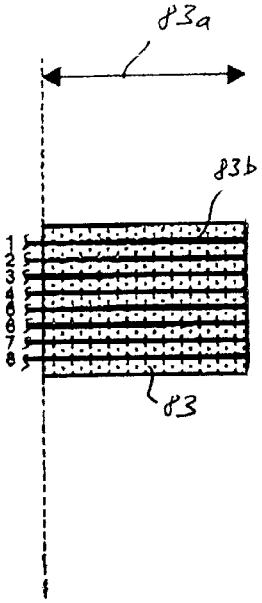
FIG. 4*a* shows diagrammatically an 8-pin plug.
Figure 4B:
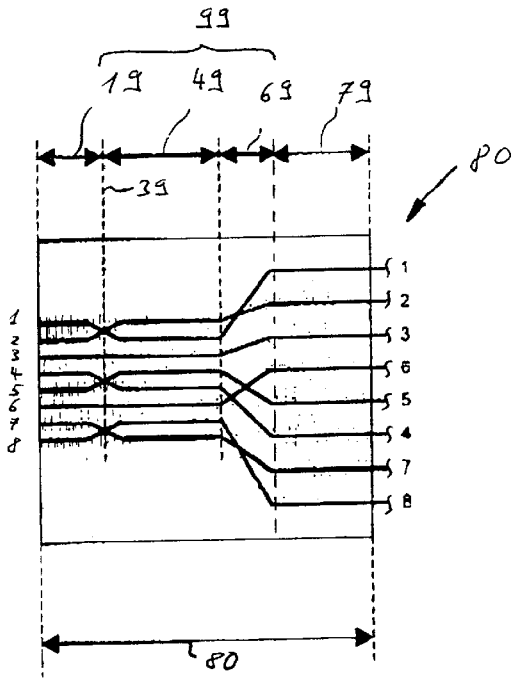
FIG. 4*b* shows diagrammatically in spread view, the course of the conductor paths in the plug connection part.
Figure 6:
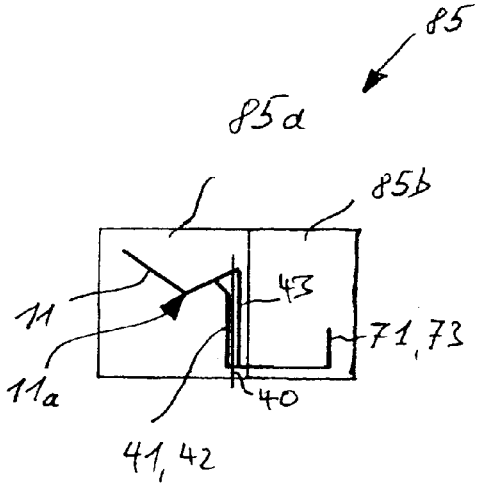
FIG. 6 shows diagrammatically a side view of the course of the conductor paths in the plug connection part.

FIG. 4*a* shows in a top view the end of the plug 83 with the eight mutually parallel contact points 83*b* which extend over a length 83*a*. FIG. 4*b* shows the course of the conductor paths 1–8 spread in one plane and here in particular the crossover of the conductor paths 1–8 in the plug connection part 80 is clear. The very short contact spring section 19 opens into the crossover section 39 in which the conductor paths 1,2; 4,5 and 7,8 mutually cross. The conductor paths 1–8 in section 49 run essentially mutually parallel and as shown in FIGS. 2, 3 and 6, in two mutually spaced planes. After the crossover section 69 the conductor paths 1–8 end in the cutting terminal area 79. Sections 39, 49 and 69 together form a compensation section 99 within which a targeted crosstalk compensation is achieved.

FIG. 6 shows diagrammatically a side view of the socket 85 with the first part housing 85*a* and second part housing 85*b*. All contact springs 11–18 run in the same plane where only the contact spring 11 with contact point 11*a* is marked. At the deflection point 29 the course of the conductor paths 1–8 changes by around 90 degrees in relation to the alignment of the contact springs 11–18. The conductor paths 1–8 then run in two parallel planes where in the one plane the conductor path sections 41, 42 and in the other plane the conductor path section 43 are shown. Between these two planes is arranged the insulator 40. This insulator 40 acting as a dielectric can for example be designed as a film, in particular a Poly-Ethylene-Terephthalate (PET) film. In a preferred embodiment the film has a thickness of less than 0.3 mm.

Figure 5:
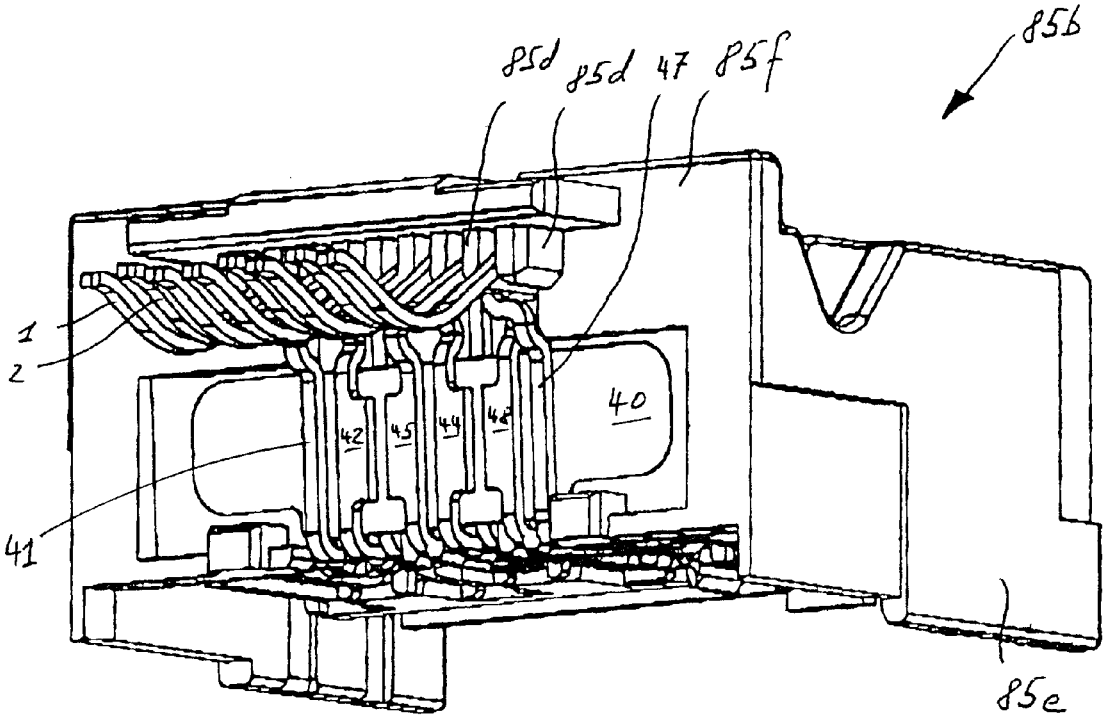
FIG. 5 shows a plug connection part arranged in a part housing.

FIG. 5 shows the perspective view of a second part housing 85*b* with part housing wall 85*e* and front wall 85*f*, where in this part housing 85*b* is arranged the plug connection part 80. The conductors 1–8 are held in the deflection section 29 between the holders 85*d* of the second housing part 85*b*. The insulator 40 lies on the front wall 85*f*. The part housing 85*b*, as shown in FIG. 6, together with the first part housing 85*a* can be assembled into a socket 85. As the section 49 or compensation section 99 is arranged essentially vertical to the longitudinal direction of the socket 85, socket 85 is very short and compact in a longitudinal direction. As the section 49 or compensation section 99 is arranged approximately in the centre in relation to the longitudinal direction of the socket 85, the electrical compensation is not sensitive to metallic screening surfaces which can be fitted outside on the socket 85 to utilize the Faraday effect. This gives this advantage that the same plug connection part 80 can be used for both screened and unscreened plug systems.

Instead of the cutting terminals solder pins can be provided as output contacts 71–78.

In a further embodiment the crossover section 69 can be omitted so that the plug connection part 80 has conductor paths 1–8 crossing only in the crossing section 39.

In a further embodiment the conductor paths 1–8 can be formed such that, in the side view in FIG. 6, they have an essentially Z-shaped course.

I claim:

1. A plug connection part, in particular for RJ45 plug connectors, comprising a multiplicity of conductor paths each having one end with a contact spring and another end with an output contact, where the contact springs run starting from an end facing away from the output contact towards the output contact, wherein, in a first cross-over section following the contact springs, portions of selected ones of the conductor paths cross portions of selected others of the conductor paths, and in a second cross-over section, remote from said first cross-over section, other portions of selected ones of the conductor paths cross further portions of selected others of the conductor paths, said first and second cross-over sections comprising a compensation section, wherein along a part length of the compensation section between said first and second cross-over sections at least two of the conductor paths run in a first plane and a plurality of others of the conductor paths run in a second plane parallel to said first plane, said first and second planes electrically separated by an insulator disposed there-between, and wherein said first and second cross-over sections do not have said insulator disposed between the respective crossed portions of the conductor paths thereof.

2. A plug connection part according to claim 1, wherein the contact springs run into a common area.

3. A plug connection part according to claim 1, wherein the contact springs are V-shaped in the direction of running of the conductor paths.

4. A plug connection part according to claim 1, wherein the conductor paths in the area of the insulator have shapes defining the areas that are dimensioned so that between certain conductor paths a prespecified capacitance is present.

5. A plug connection part according to claim 1, wherein the insulator is arranged running essentially vertically to the contact springs.

6. A plug connection part according to claim 1, wherein pairs of the conductor paths run crossed within the compensation section.

7. A plug connection part according to claim 1, wherein the output contact is a cutting terminal.

8. A plug connection part according to claim 1, wherein the output contact is a solder pin.

9. A plug connection part according to claim 1, wherein the insulator is formed as a PET film and has a thickness of less than 0.3 mm.

10. A plug connection part according to claim 1, wherein the conductor paths run in an essentially Z-shaped course.

11. A plug connection part according to claim 1, wherein each of the conductor paths along a part length of the compensation section runs in one of two parallel planes between which is arranged the insulator.

12. A plug connection part according to claim 11, wherein a third and a sixth conductor path along said part length of said compensation section runs in said first plane; and a first, a second, a fourth, a fifth, a seventh and an eight conductor path along said part length of said compensation section runs in said second plane.

13. A socket comprising a plug connection part, the plug connection part comprising a multiplicity of conductor paths each having one end with a contact spring and another end with an output contact, where the contact springs run starting from an end facing away from the output contact towards the output contact, wherein, in a first cross-over section following the contact springs, portions of selected ones of the conductor paths cross portions of selected others of the conductor paths, and in a second cross-over section, remote from said first cross-over section, other portions of selected ones of the conductor paths cross further portions of selected others of the conductor paths, said first and second cross-over sections comprising a compensation section, wherein along a part length of the compensation section between said first and second cross-over sections at least two of the conductor paths run in a first plane and a plurality of others of the conductor paths run in a second plane parallel to said first plane, said first and second planes electrically separated by an insulator disposed there-between, and wherein said first and second cross-over sections do not have said insulator disposed between the respective crossed portions of the conductor paths thereof.

* * * * *